US006881932B2

(12) United States Patent
Giterman

(10) Patent No.: US 6,881,932 B2
(45) Date of Patent: Apr. 19, 2005

(54) HIGH RELIABILITY HEATER MODULES

(75) Inventor: Igor Giterman, Woodbridge, CT (US)

(73) Assignee: Harco Laboratories, Inc., Branford, CT (US)

( * ) Notice: Subject to any disclaimer, the term of this patent is extended or adjusted under 35 U.S.C. 154(b) by 170 days.

(21) Appl. No.: 10/425,814

(22) Filed: Apr. 29, 2003

(65) Prior Publication Data

US 2004/0217106 A1 Nov. 4, 2004

(51) Int. Cl.[7] ..... H05B 1/02

(52) U.S. Cl. ..... 219/486; 219/485; 219/481; 219/505; 338/22 R

(58) Field of Search ..... 219/483–486, 219/481, 497, 504, 505, 508; 338/22 R, 225 C; 374/102–107

(56) References Cited

U.S. PATENT DOCUMENTS 4,000,647 A 1/1977 Tauchmann
4,121,088 A 10/1978 Doremus et al.
4,458,137 A 7/1984 Kirkpatrick
4,549,706 A * 10/1985 Stickney ..... 244/1 R
5,464,965 A 11/1995 McGregor et al.
6,070,475 A 6/2000 Muehlhauser et al.
6,278,596 B1 * 8/2001 Simpson ..... 361/42
6,369,369 B2 * 4/2002 Kochman et al. ..... 219/545

* cited by examiner

*Primary Examiner*—Mark Paschall
(74) *Attorney, Agent, or Firm*—St. Onge Steward Johnston & Reens LLC

(57) ABSTRACT

An improved air data sensing probe de-icing system that provides for dramatically increased reliability and lifespan, utilizing solid-state heating elements that are electrically connected in parallel and having inherent temperature control, where each of the heating elements are able to provide full system power in the event of failure of one of the heating elements such that system redundancy and de-rating is achieved.

19 Claims, 4 Drawing Sheets

HIGH RELIABILITY HEATER MODULES

FIELD OF THE INVENTION

The invention relates to a compact, highly reliable de-icing system for use with air data sensing probes, that utilizing de-rated solid-state heating elements that are each capable of supplying the full system heating load in the event of failure of one or more of the heating elements.

BACKGROUND OF THE INVENTION

Air data sensing probes are utilized in aircraft to sense various air properties such as total pressure, static pressure, total temperature, etc. A major problem with conventional air data sensing probes is that ice builds up on the probe, which in turn, may lead to false reading or may temporarily cause the probe to stop functioning. As the pilot of the aircraft must rely upon the continuous and proper functioning of the instrumentation of the aircraft, poorly functioning or malfunctioning air data sensing probes are unacceptable.

In order to de-ice air data sensing probes, a number of approaches have been taken. For instance, conventional resistive heaters have been utilized. Heaters have traditionally used one heating element with or without temperature control.

One type of heater utilized in conjunction with air data sensing probes is a resistive type heater such as a metal core heater. However, there are a number of disadvantages inherently associated with utilizing metal core heaters. For instance, a metal core heater utilized without temperature control operates at high temperature, and is therefore relatively unreliable because they frequently burn out. A metal core heater used with linear temperature control usually has an associated electronic module. However, electronic modules have poor efficiency, add cost and reduce reliability of the overall system. Alternatively, a metal core heater may be used with an "on/off" temperature control. However, these too contain electronic modules that generate high current noise on power lines, add cost and reduce reliability of the overall system. Another problem related to resistive type heater is that the associated control element requires additional space, which is severely limited on an aircraft. Therefore, heating systems that require additional electronic controls for proper operation are undesirable.

Another type of heater that may be used in conjunction with air data sensing probes is a solid-state heater. Solid-state heaters have the advantage of inherent temperature control. In addition, solid-state heaters are relatively compact and small in size. However, a major disadvantage to use of a single solid-state heater element is that solid-state heaters are notoriously unreliable, having a relatively short lifespan prior to failing or burning out. Therefore, traditionally solid-state heater elements have not been utilized.

A number of patent have sought to provide heating system for air data sensing probes, however none of these have provided an effective and highly reliable de-icing system.

One such system is disclosed in U.S. Pat. No. 5,464,965 to McGregor ("the '965 patent"). The '965 patent discloses the use of a controller for regulating the temperature of air data probes with a resistive element such that the resistance of the element varies with temperature. Although the space required for the associated electronics is reduced, associated circuitry is still required, which in turn requires additional space. The additional circuitry performs analog calculation base on the instantaneous applied voltage and current returned through the resistive element. Another disadvantage of the system disclosed in the '965 patent is that it teaches the use of resistive type heaters which suffer from the inherent problems discussed above.

Another system is disclosed in U.S. Pat. No. 4,458,137 to Kirkpatrick ("the '137 patent"). The '137 patent discloses use of an air data sensor device having a first resistive heater connected in series with a positive temperature coefficient ("PTC") resistive heater and a second resistive heater connected in parallel with the first resistive heater so as to increase the system heating capacity. Although the control circuitry for the '137 patent will be reduced by utilization of a PTC heater, addition control circuitry is necessary for control of the resistive type heater which will require additional space. Although the '137 patent discloses the connection of the resistive type heaters in parallel so as to generate more heat, this will not increase the lifespan or reliability of any of these resistive heaters. Rather, the '137 patent is directed toward solving the problem of avoiding excessive heating of the probe itself thereby causing damage to the sensor rather than the heating elements. The '137 patent accomplishes this by regulating the resistive heaters based upon the air temperature so as not to overheat the probe, however nothing is disclosed with regard to extending the life of, increasing the reliability of, or reducing the cost of maintaining the heater elements themselves. A further limitation of the '137 patent is use of a PTC heater. PTC heaters are self-regulating with temperature, however they are characterized with having a linear response to temperature change and are limited to approximately a 1 to 4 heating ratio. For instance, if a 40 watt heater is utilized, the PTC heater will range between 10–40 watts based upon the temperature. The heating capacity of PTC heaters also limited, such that standard resistive type heaters are utilized in connection with them to increase heating capacity as disclosed, for instance, in the '137 patent.

Still another system is disclosed in U.S. Pat. No. 4,121,088 to Doremus et al. ("the '088 patent"). The '088 patent discloses a PTC resistive heater made up of a plurality of individual PTC resistors connected electrically or mechanically in parallel by flexible electrically conductive perforated strips. Individual heater resistors are encapsulated and connected in parallel to accommodate different coefficients of expansion between the heater material and the sensor material so as to avoid overheating of the probe casing so as not to crack or damage it. The use of a PTC restive heater is disclosed where the resistance of the heating elements varies with temperature. However the use of parallel connected resistive type heater, as disclosed in the '088 patent is designed to minimize damage caused to the probe itself due to overheating of the heating elements. The system disclosed in the '088 patent will not extend the life of the heating elements themselves to reduce maintenance costs and increase reliability.

A further system is disclosed in U.S. Pat. No. 4,000,647 to Tauchmann ("the '647 patent"). The '647 patent discloses a thermal controlled resistor means that exhibits a low increase of resistance within a specific temperature range and a high increase in resistance within an adjacent range. However the use of a thermally controlled resistive type heater, as disclosed in the '647 patent, requires the use of additional control circuitry which introduces the inherent problems discussed above and requires additional space to house the control circuitry.

Therefore, what is desired is a highly reliable heating system for de-icing an air data sensing probe.

It is also desired to provide a de-icing system for air data sensing probes that avoids the inherent problems associated with traditional resistive type heaters.

It is further desired to provide a de-icing system for air data sensing probes that will function for an extended period of time without need of replacement.

It is yet further desired to provide a de-icing system for air data sensing probes that requires a minimal amount of space.

It is also desired to provide a de-icing system for air data sensing probes that minimizes the cost associated with maintaining the de-icing system in operable condition.

SUMMARY OF THE INVENTION

To achieve the above-stated objectives a de-icing system for use with air data sensing probes has been provided that utilizes solid-state technology for the heating elements. Solid-state heaters have the advantage of being compact in size and do not require associated control electronics to control the heating elements, as solid-state heaters have inherent temperature control built into the heating element itself. This will greatly reduce the space required for the de-icing system.

To overcome the reliability problems associated with solid-state heaters, redundancy and de-rating of the heating elements themselves has been found to dramatically increase the reliability and lifespan of solid-state heating elements utilized for de-icing systems in air data sensing probes. This will not only increase the reliability of the de-icing system, but will also reduce the costs associated with replacement and/or repair of the de-icing system if it fails. The costs associated with adding one or more additional solid-state heaters in parallel with a first solid-state heater is minimal when compared to the cost impact (replacement cost and/or downtime for the aircraft) of having to replace or repair a failed de-icing system for an air data sensing probe.

To that end, a number of advantageous embodiments of the present invention are provided to achieve the above-stated objectives.

In one advantageous embodiment, an air probe de-icing system is provided, including a first solid-state heating element with a selected wattage rating and having a first integrated heating control. The system further includes a second solid-state heating element with a selected wattage rating, and a second integrated heating control, and the second solid-state heating element is electrically connected in parallel with the first solid-state heating element. The system is provided such that the selected wattage rating for each of the first solid-state heating element and the second solid-state heating element are selected to be at least as large as the total system heating load such that if one of the first or the second solid-state heating elements fails, the remaining solid-state heating element can handle the total system heating load so as to provide system redundancy.

In another advantageous embodiment, an air probe de-icing system is provided, including a solid-state heating unit having a first solid-state heating element, for generating heat to de-ice the air probe, with a first power rating and integral self-regulating heating control, and a second solid-state heating element, for generating heat to de-ice the air probe, with a second power rating and integral self-regulating heating control. The system is provided such that the second solid-state heating element is electrically connected in parallel with the first solid-state heating element. The solid-state heating unit further includes a casing, for encapsulating both the first solid-state heating element and the second solid-state heating element. The air probe de-icing system further includes an electrical power source, for generating electrical power that is electrically connected to the first and the second solid-state heating elements. Finally, the system is provided where the first power rating and the second power rating are at least as large as a total system heating load such that if one of the first or the second solid-state heating elements fails, the remaining solid-state heating element can handle the total system heating load so as to provide system redundancy.

In still another advantageous embodiment, a method for de-icing an air probe is provided comprising the steps of determining a total system heating load, selecting a first solid-state heating element having a specific wattage rating that is at least equal to the total system heating load, and providing a first integrated heating control, for controlling the first solid-state heating element. The method further includes the steps of selecting a second solid-state heating element having a specific wattage rating that is at least equal to the total system heating load, providing a second integrated heating control, for controlling the second solid-state heating element, and electrically connecting the first solid-state heating element in parallel with the second solid-state heating element. Finally, the method includes the step of controlling the first and the second solid-state heating elements with the first and the second integrated heating controls respectively such that the power emitted by the first solid-state heating element is less than the specific wattage rating for the first solid-state heating element, and the power emitted by the second solid-state heating element is less than the specific wattage rating for the second solid-state heating element.

The invention and its particular features and advantages will become more apparent from the following detailed description considered with reference to the accompanying drawings.

DETAILED DESCRIPTION OF THE DRAWINGS

Resistive type heating elements are presently being utilized for de-icing system in air data sensing probes. Resistive type heating elements have, as a rule, been much more reliable than solid-state heating elements, which could not be used in critical applications. Therefore, resistive type heating elements have become the standard in the industry A major benefit however, of utilizing a solid-state heating element to de-ice an air data probe is that solid-state heating elements automatically control their own temperature by changing resistance based upon the ambient temperature. When the temperature of the solid-state heating element is relatively low, which will be based upon the actual ambient temperature, the resistance of the solid-state heating element is relatively low such that it provides a large amount of heat based upon the formula:

$$\text{Heat Dissipated}=V^2/R \quad \text{(formula 1)}$$

(where V is applied voltage, and R is the resistance of the heating element)

As the solid-state heating element provides more heat, it heats the environment and the heating element itself. As the temperature of the heating element continues to rise, the resistance of the heating element also increases generating less heat until it eventually reaches the control point. This automatic process control loop will continue as long as power is applied to the solid-state heating element. Therefore, heating units equipped with a solid-state heating element will automatically control the amount of heat dissipated by the heating element based upon ambient temperature.

Traditionally however, solid-state heating elements have not been utilized with critical systems such as aircraft instruments, anti-iced probes or de-iced probes because of the relatively low reliability of the solid-state heating elements themselves. Therefore solid-state heating elements have traditionally been unusable with, for instance, air data probes.

However, it has been determined that when two or more solid-state heating elements are electrically connected in parallel, the heating elements become much more reliable because of automatic power sharing.

Figure 1:
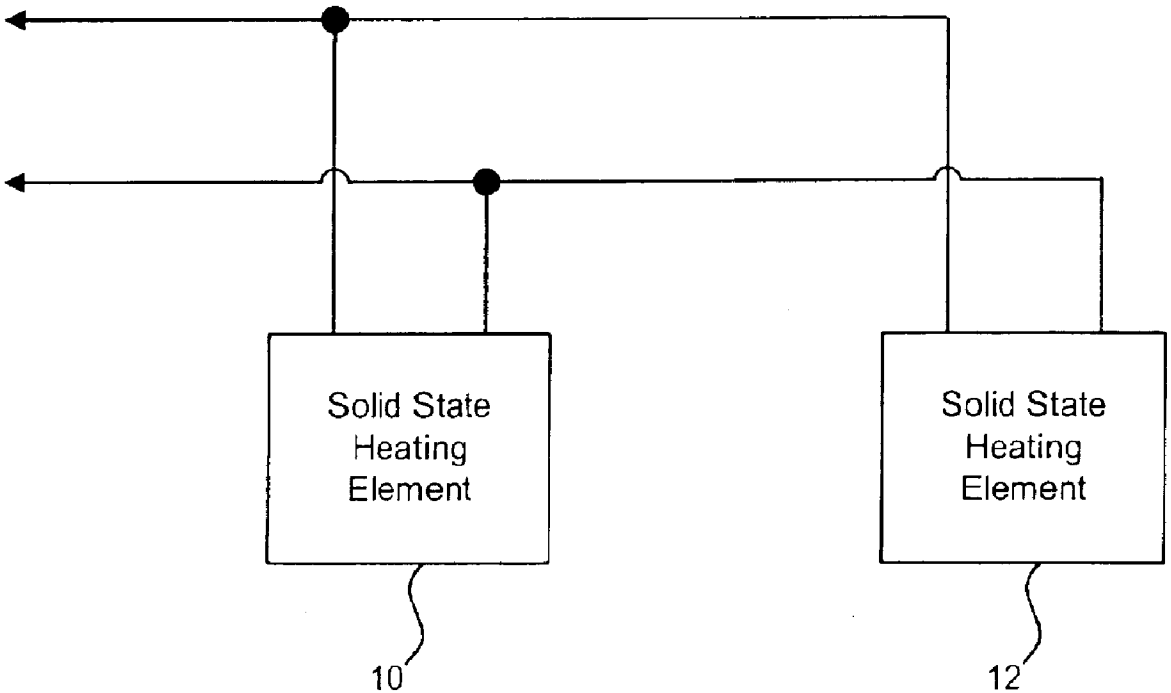
FIG. 1 is a block diagram illustrating an embodiment of the air probe de-icing system where two solid-state heaters connected in parallel.

FIG. 1 illustrates two solid-state heating elements (10, 12) that are electrically connected in parallel. Solid-states heating elements (10, 12) are provided with integral automatic temperature control such that the resistance of solid-state heating elements (10, 12) will vary with the ambient temperature as previously described. Solid-states heating elements (10, 12) may then be connected to an electrical source of power (not shown). The means provided for electrically connecting solid-state heating elements (10, 12) in parallel with each other, and to an electrical source of power (not shown), may be any means commonly known in the field, such as; soldered connections, friction connections, or any other mechanical means for connecting of and to the electrical conductors.

In one advantageous embodiment, solid-state heating elements (10, 12) are selected to be equal to each other and that each is equal to the total system heating load. In this advantageous embodiment, when N number of the same heating elements are electrically connected in parallel, each heating element will provide 1/N of the total power, which in turn, will dramatically increase the reliability of the heating element itself. Where for instance in FIG. 1, two solid-state heating elements (10,12) are utilized, each solid-state heating element is selected to, at a minimum, supply the total system heating load such that in the event of a failure of one of the solid-state heating elements, the remaining heating element can fully supply all the heating required for the application. Where two solid-state heating elements are utilized, this would mean that, providing the selected heating elements are equal, each would provide approximately half of the total system heating.

As an example, if 45 watts is assumed as the total system heating load required, two 45 watt solid-state heating elements may be electrically connected in parallel, such that each solid-state heating element will supply exactly 22.5 watts of heating for the de-icing system. Since the dissipation of each element decreases with an increased number of elements, the mean time between failures ("MTBF") of the individual heating elements also increases, and the overall system MTBF increases dramatically. For instance, a 45 watt solid-state heating element has a MTBF of approximately 10,000 hours. In our example, two 45 watt solid-state heating elements are electrically connected in parallel such that the MTBF of each heating element increases to approximately 20,000 hours. However, the overall system MTBF increases to 400,000,000 hours.

In the past, the low reliability of solid-state heating elements prevented their use in connection with air probe de-icing systems. Now however, because of redundancy and de-rating which leads to the associated very large overall system MTBF, solid-state heating elements may now be utilized for air probe de-icing systems applications. This is advantageous because of their small size, versatility as compared to resistive type heaters, inherent temperature control, and low cost.

The additional cost associated with adding a second solid-state heating element to the air probe de-icing system, when compared against the increased lifespan and corresponding replacement and/or repair cost is negligible. In addition, because each solid-state heating element has inherent temperature control, no added control circuitry is necessary for the additional solid-state heating element.

It should be noted that the examples cited herein, utilize only two solid-state heating elements, however, any number of additional heating elements may be utilized. In fact, the more solid-state heating elements that are electrically connected in parallel, the lower the power dissipation will be for each heating element, and the higher the overall system MTBF will be. The benefit to continuing to add additional heating elements however, will be limited by space restrictions for the heating elements themselves.

It should also be noted that the example cited herein, utilize solid-state heating elements that each have the same wattage value. This is not necessary, as any combination of wattages can be utilized. Note that according to formula 1, the heat dissipated is equal to the applied voltage squared, divided by the resistance of the heating element that varies according to temperature. In addition, the total power output capacity of the electrical source of power is limited such that the heating element cannot damage itself. To achieve a maximum increase in the reliability of the de-icing system, each solid-state heating element should be selected such that, the total system heating load can be supplied by any of the heating elements individually.

Utilization of standard resistive type heaters in parallel simply will not give the advantages realized with solid-state heating elements. For instance, metal core heaters connected in parallel and without temperature control, will still individually dissipate the same amount of heat as when only one is connected, thereby doubling the system power and increasing temperature. This will not provide for increased reliability or lifespan of the heating elements. Further, the system is provided without heating control, which may cause damage to the air data sensing probe itself.

Even utilizing metal core heaters connected in parallel and with temperature control will not achieve the desired benefits of the present invention because two metal core heaters requires two associated control circuits. These in turn add to system cost and size. Further, there will not be a large increase in system reliability because the control circuit will dominate the reliability performance, as these too tend to have limited life spans.

Figure 2:
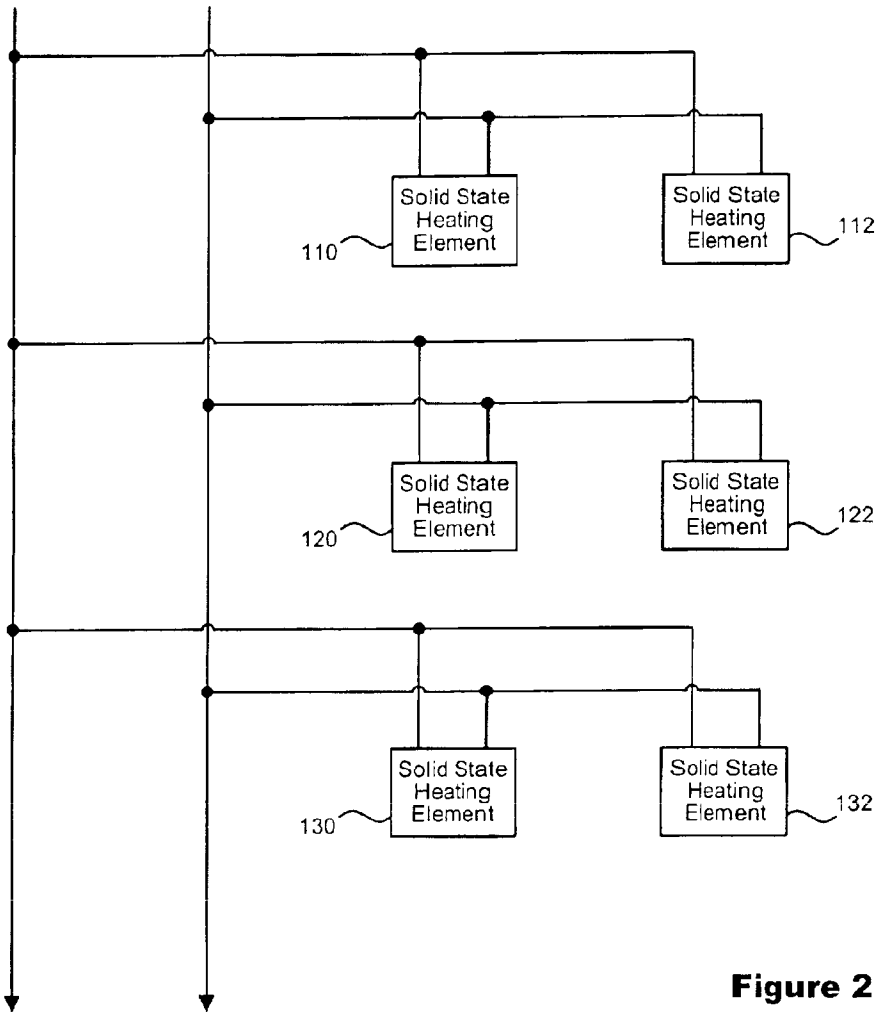
FIG. 2 is a block diagram illustrating an embodiment of the air probe de-icing system where multiple sets of solid-state heaters are connected in parallel and are further connected to a power source.

FIG. 2 illustrates multiple sets of two solid-state heating elements connected in parallel. For instance, the first set of solid-state heating elements (110, 112) is depicted where solid-state heating elements (110, 112) are electrically connected in parallel with each other and may heat a particular portion of the air data sensing probe (not shown). The second set of solid-state heating elements (120, 122) is also depicted where solid-state heating elements (120, 122) are electrically connected in parallel with each other and may heat a second particular portion of the air data sensing probe. Finally, the third set of solid-state heating elements (130, 132) is shown where solid-state heating elements (130, 132) are electrically connected in parallel with each other and may heat yet a third particular portion of the air data sensing probe Note that three sets of solid-state heating elements are depicted in FIG. 2, however any number of sets of heating elements may be utilized depending upon the particular application.

In addition, the sets of solid-state heating elements as depicted in FIG. 2 may comprise heating elements that each have the same wattage ratings or they may have differing wattage ratings. So too, the system heating load for the air data sensing probe may vary over differing portions of the probe itself. Therefore, the heating load of each set of solid-state heating elements may also vary accordingly.

Figure 3:
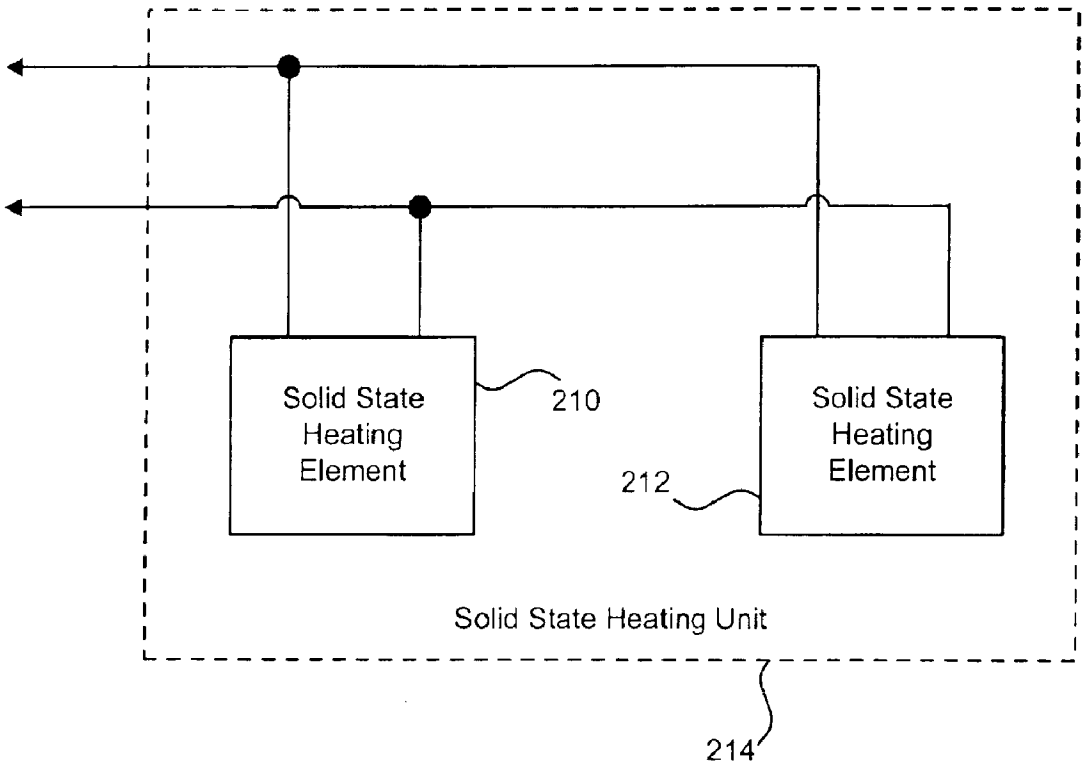
FIG. 3 is a block diagram illustrating an embodiment of the air probe de-icing system where two solid-state heaters connected in parallel and are enclosed as a discrete solid-state heater unit.

FIG. 3 depicts still another advantageous embodiment of the present invention. Here solid-state heating elements (210, 212) are shown electrically connected in parallel with each other. Solid-state heating elements (210, 212) operate in the same manner as previously described for FIG. 1 and will not be repeated here.

Solid-state heating unit 214 is also shown in FIG. 3. Solid-state heating unit 214 comprises solid-state heating elements (210, 212), which are enclosed by a casing that can be made up of any suitable thermally conductive material. Electrical conductors are shown exiting solid-state heating unit 214, which may be connected to an electrical source of power (not shown).

It should be noted that although only two solid-state heating elements (210, 212), are shown in FIG. 3, any number of heating elements may be utilized depending upon the application.

Figure 4:
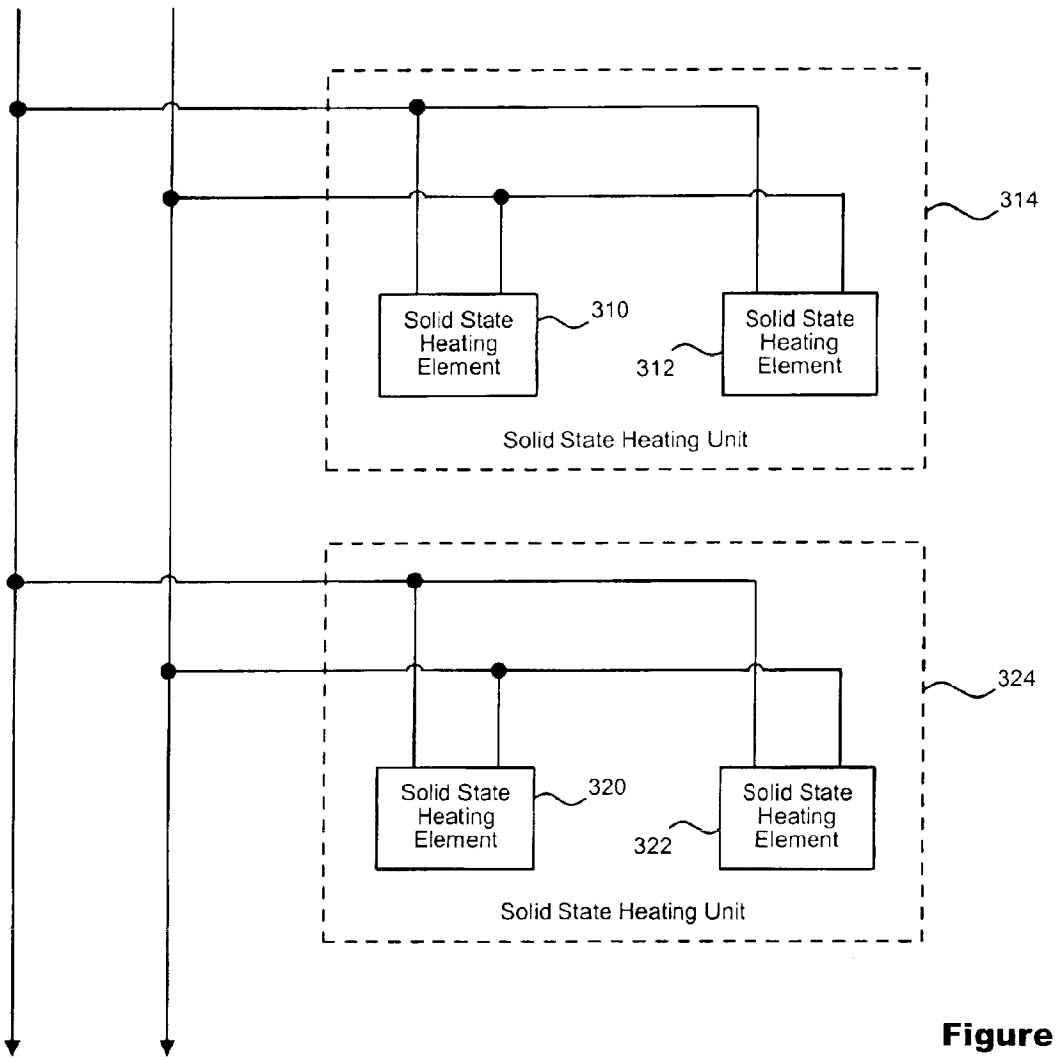
FIG. 4 is a block diagram illustrating an embodiment of the air probe de-icing system where multiple sets of discrete solid-state heater units are connected in parallel and are further connected to a power source.

FIG. 4 illustrates multiple sets of solid-state heating units connected in parallel to an electrical source of power (not shown). For instance, solid-state heating unit 314 is shown and includes solid-state heating elements (310, 312) electrically connected in parallel with each other. Also shown is solid-state heating unit 324 that includes solid-state heating elements (320, 322), which are also electrically connected in parallel with each other.

Although only two solid-state heating units are illustrated in FIG. 4, any number of discrete two solid-state heating units may be utilized in conjunction with a particular air data sensing probe. The particular heating capacity, total number, and location of solid-state heating units required for use with a particular air data sensing probe will vary based upon the application.

Any appropriate combination of solid-state heating elements may be used which further adds to the versatility of the de-icing system. Further, the compact size of solid-state heating elements provides the advantage of being able to utilize the heating elements in locations with very limited space. The fact that multiple solid-state heating elements are utilized also facilitates having a more even heat distribution over the air data sensing probe. Alternatively, the ability to individually add more heating elements to a particular location of the air data sensing probe may be advantageous in a particular application.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An air probe de-icing system comprising:

a first solid-state heating element with a selected wattage rating, having a first integrated heating control;

a second solid-state heating element with a selected wattage rating, having a second integrated heating control, and said second solid-state heating element is electrically connected in parallel with said first solid-state heating element; and wherein the selected wattage rating for each of said first solid-state heating element and said second solid-state heating element are selected to be at least as large as a total system heating load such that if one of said first or said second solid-state heating elements fails, the remaining solid-state heating element can handle the total system heating load so as to provide system redundancy.

2. The air probe de-icing system of claim 1 wherein the selected wattage rating of said first solid-state heating element is equal to the selected wattage rating of said second solid-state heating element.

3. The air probe de-icing system of claim 1 wherein the selected wattage rating of said first solid-state heating element is different from the selected wattage rating of said second solid-state heating element.

4. The air probe de-icing system of claim 1 wherein the first and the second integrated heating controls each control the respective solid-state heating elements they are associated with by changing the resistance of said solid-state heating elements respectively.

5. The air probe de-icing system of claim 4 wherein the first and the second integrated heating controls are self-regulating.

6. The air probe de-icing system of claim 5 wherein the first and the second integrated heating controls are self-synchronizing.

7. The air probe de-icing system of claim 1 wherein said first and said second solid-state heating elements are electrically connected to source of electrical power.

8. An air probe de-icing system comprising:

a solid-state heating unit having:

a first solid-state heating element, for generating heat to de-ice the air probe, having a power rating and integral self-regulating heating control;

a second solid-state heating element, for generating heat to de-ice the air probe, having a power rating and integral self-regulating heating control, a third solid-state heating element, for generating heat to de-ice the air probe, having a power rating and integral self-regulating heating control, and said third solid-state heating element is electrically connected in parallel with said first and said second solid-state heating elements;

an electrical power source, for generating electrical power, electrically connected to said first, second and third solid-state heating elements, wherein the various power ratings are selected such that in the event any one solid-state heating element fails, the remaining solid-state heating elements can handle the total system heating load so as to provide system redundancy.

9. The air probe de-icing system of claim 8 wherein the various power ratings of the solid-state heating elements are equal to each other.

10. The air probe de-icing system of claim 8 wherein the various power ratings of the solid-state heating elements are different from each other.

11. The air probe de-icing system of claim 8 wherein the integral self-regulating heating controls of said first, second and third solid-state heating elements each control the respective solid-state heating elements they are associated with by changing a resistance of the respective solid-state heating element.

12. The air probe de-icing system of claim 8 wherein the integral self-regulating heating controls of said first, second and third solid-state heating elements are self-synchronizing.

13. A method for de-icing an air probe comprising the steps of:

determining a total system heating load;

selecting a first solid-state heating element having a specific wattage rating that is at least equal to the total system heating load;

providing a first integrated heating control, for controlling the first solid-state heating element;

selecting a second solid-state heating element having a specific wattage rating that is at least equal to the total system heating load;

providing a second integrated heating control, for controlling the second solid-state heating element;

electrically connecting the first solid-state heating element in parallel with the second solid-state heating element; and controlling the first and the second solid-state heating elements with the first and the second integrated heating controls respectively such that the power emitted by the first solid-state heating element is less than the specific wattage rating for the first solid-state heating element, and the power emitted by the second solid-state heating element is less than the specific wattage rating for the second solid-state heating element.

14. The method for de-icing an air probe according to claim 13 wherein the specific wattage rating of the first solid-state heating element is equal to the specific wattage rating of the second solid-state heating element.

15. The method for de-icing an air probe according to claim 13 wherein the specific wattage rating of the first solid-state heating element is different from the specific wattage rating of the second solid-state heating element.

16. The method for de-icing an air probe according to claim 13 wherein the step of controlling the first and the second solid-state heating elements with the first and the second integrated heating controls respectively further comprising the step of utilizing the first and the second solid-state heating elements to measure the air temperature and then changing a resistance of the first and the second solid-state heating elements respectively based upon the measured air temperature.

17. The method for de-icing an air probe according to claim 13 wherein the first and the second integrated heating controls are self-regulating.

18. The method for de-icing an air probe according to claim 17 wherein the first and the second integrated heating controls are self-synchronizing.

19. The method for de-icing an air probe according to claim 13 further comprising the steps of:

providing an electrical power source; and electrically connecting the electrical power source to the first and the second solid-state heating elements.

* * * * *